US011207610B2

(12) United States Patent
Rosen et al.

(10) Patent No.: US 11,207,610 B2
(45) Date of Patent: Dec. 28, 2021

(54) AMUSEMENT DEVICE WITH WRITING/DRAWING SURFACE

(71) Applicant: LAROSE INDUSTRIES, LLC, Randolph, NJ (US)

(72) Inventors: Lawrence Rosen, Mendham, NJ (US); Parviz Daftari, Summit, NJ (US); Joseph Anthony Nardozza, Jr., Morristown, NJ (US)

(73) Assignee: LAROSE INDUSTRIES, LLC, Randolph, NJ (US)

( * ) Notice: Subject to any disclaimer, the term of this patent is extended or adjusted under 35 U.S.C. 154(b) by 153 days.

(21) Appl. No.: 16/779,341

(22) Filed: Jan. 31, 2020

(65) Prior Publication Data

US 2020/0164282 A1 May 28, 2020

Related U.S. Application Data

(63) Continuation-in-part of application No. PCT/US2019/018288, filed on Feb. 15, 2019.
(Continued)

(51) Int. Cl.
*A63H 33/22* (2006.01)
*A63H 3/36* (2006.01)

(52) U.S. Cl.
CPC ..... *A63H 33/22* (2013.01); *A63H 3/36* (2013.01)

(58) Field of Classification Search
CPC ..... A63H 33/22; A63H 33/006; A63H 3/36; F21V 14/08; F21V 14/00; F21V 21/0832;
(Continued)

(56) References Cited

U.S. PATENT DOCUMENTS 3,808,721 A 5/1974 Gersch
4,173,038 A 10/1979 Kiefer
(Continued)

FOREIGN PATENT DOCUMENTS

WO 2019161254 A1 8/2019

OTHER PUBLICATIONS

Notification of Transmittal of the International Search Report and Written Opinion of the International Searching Authority, or the Declaration dated Apr. 25, 2019 in International Patent Application No. PCT/US2019/018288. (17 pages).

*Primary Examiner* — Joseph L Williams
*Assistant Examiner* — Jose M Diaz
(74) *Attorney, Agent, or Firm* — Lewis Roca Rothgerber Christie LLP

(57) ABSTRACT

An amusement device includes a housing and a light unit positioned on the housing. A mounting ring is rotatably positioned on the housing, encircling the light unit. The amusement device also includes a rotatable, dome-shaped cover sized and shaped so as to be mounted on the mounting ring for conjoint rotation therewith. The rotatable, dome-shaped cover has an outer hemispherical surface adapted for covering the light unit and for placement of markings thereon. The light unit is adapted to illuminate the rotatable cover and any markings placed thereon. A motor unit is positioned in the housing for rotating the mounting ring and hence the cover and any markings thereon. Optionally, the amusement device may be provided with a stationary, dome-shaped cover having an outer hemispherical surface which is sized and shaped so as to be positioned over the rotatable cover and in spaced relationship thereto. The outer hemispherical surface of the stationary cover is adapted to receive markings thereon, whereby any markings placed on the
(Continued)

rotatable cover are rotatable relative to any markings placed on the stationary cover upon rotation of the rotatable cover.

16 Claims, 8 Drawing Sheets

Related U.S. Application Data

(60) Provisional application No. 62/710,418, filed on Feb. 16, 2018.

(58) Field of Classification Search
CPC ..... F21V 21/08; F21V 21/104; F21V 3/02; F21V 3/00; F21V 3/10; F21V 3/049; F21V 23/0442; F21V 23/04; F21V 17/002; F21V 17/10; F21V 19/00; F21V 33/008; F21S 8/063; F21S 10/063; F21S 10/00; F21S 10/005; F21S 10/06; F21Y 2115/10; F21Y 2101/00; F21W 2121/00
See application file for complete search history.

(56) References Cited

U.S. PATENT DOCUMENTS

| | | | | |
|---|---|---|---|---|
| 5,324,224 | A | 6/1994 | Anderson et al. | |
| 6,022,118 | A | 2/2000 | Wu | |
| 6,283,604 | B1 | 9/2001 | Liao | |
| 6,869,208 | B2 | 3/2005 | Vogel et al. | |
| 7,175,298 | B2 | 2/2007 | Schou | |
| 7,594,349 | B2 | 9/2009 | Rudell et al. | |
| 8,454,222 | B2 | 6/2013 | Levon | |
| 9,109,793 | B2 | 8/2015 | Menow et al. | |
| 9,587,806 | B2 | 3/2017 | Liu | |
| 2004/0093776 | A1 | 5/2004 | Laun | |
| 2011/0013375 | A1* | 1/2011 | Menow | F21V 33/008 362/34 |
| 2011/0164222 | A1 | 7/2011 | Noh | |

* cited by examiner

AMUSEMENT DEVICE WITH WRITING/DRAWING SURFACE

CROSS-REFERENCE TO RELATED APPLICATION

This application is a continuation-in-part of PCT application No. PCT/US19/18288 filed Feb. 15, 2019 which designates the United States and which claims the benefit of U.S. Patent Application No. 62/710,418 filed Feb. 16, 2018, the entire disclosures of both of which applications are incorporated herein by reference.

FIELD OF THE INVENTION

The present invention relates to amusement devices, and more particularly, to an amusement device that illuminates and allows a user to draw or write on a surface thereof.

BACKGROUND OF THE INVENTION

A variety of toy devices are presently available for providing fun and amusement to users, such as children. Materials that are adapted for coloring, decorating or drawing, such as coloring books or sticker sheets, have long-standing popularity. Another class of amusement devices involves illumination and light effects. New toys are constantly being introduced to consumers for providing different or new user-experiences and/or amusement.

SUMMARY OF THE INVENTION

In accordance with embodiments of the present invention, an amusement device includes a housing and a light unit positioned on the housing. The housing is configured to receive a cover that can surround and conceal the exposed portion of the light unit. A mounting ring is rotatably positioned on the housing, encircling the light unit. The cover is sized and shaped so as to be mounted on the mounting ring for conjoint rotation therewith. The cover has an outer hemispherical surface adapted for placement of markings and the like thereon. The light unit is adapted to illuminate the cover and any markings placed thereon. A motor unit is positioned in the housing for rotating the mounting ring and hence the cover, creating a rotational motion effect as the markings on the cover are lit up. To this end, a control unit is positioned in the housing and adapted to actuate the motor unit such that the cover is rotatable upon actuation of the motor unit.

In some embodiments, the amusement device includes a pair of covers, namely, an inner cover rotatable relative to a supportive housing and an outer cover, sized and shaped so as to be mounted in a stationary location on the housing. In an embodiment, the inner cover has an outer hemispherical surface adapted for placement of markings thereon, while the outer cover has its own outer hemispherical surface adapted for shrouding the inner cover and for placement of markings thereon. Upon rotation of the inner cover via its associated motor-actuated mounting ring, the outer hemispherical surface of the inner cover moves relative to the outer hemispherical surface of the outer cover, whereby markings on the inner cover move relative to markings on the outer cover.

To enhance amusement, a control interface, such as a plurality of buttons, can manipulate the light unit to produce one or more light effects. The buttons can have functions such as: turning on/off a plurality of light elements, changing the color of the light elements, implementing a fading light effect, implementing a blinking light effect; toggling UV light elements on/off, and cycling the light elements between various lit states and associated light effects. Some of the light elements can be oriented at a first angle, while other light elements are oriented at a second angle different from the first angle.

BRIEF DESCRIPTION OF THE DRAWINGS

In the following figures, which are not to scale, and where like reference numerals indicate like elements throughout the several views:

FIG. 9 is a top perspective view of the single-globe amusement device shown in FIG. 7, with its globe or cover decorated with markings or the like.

DESCRIPTION OF EMBODIMENTS OF THE INVENTION

Figure 1:
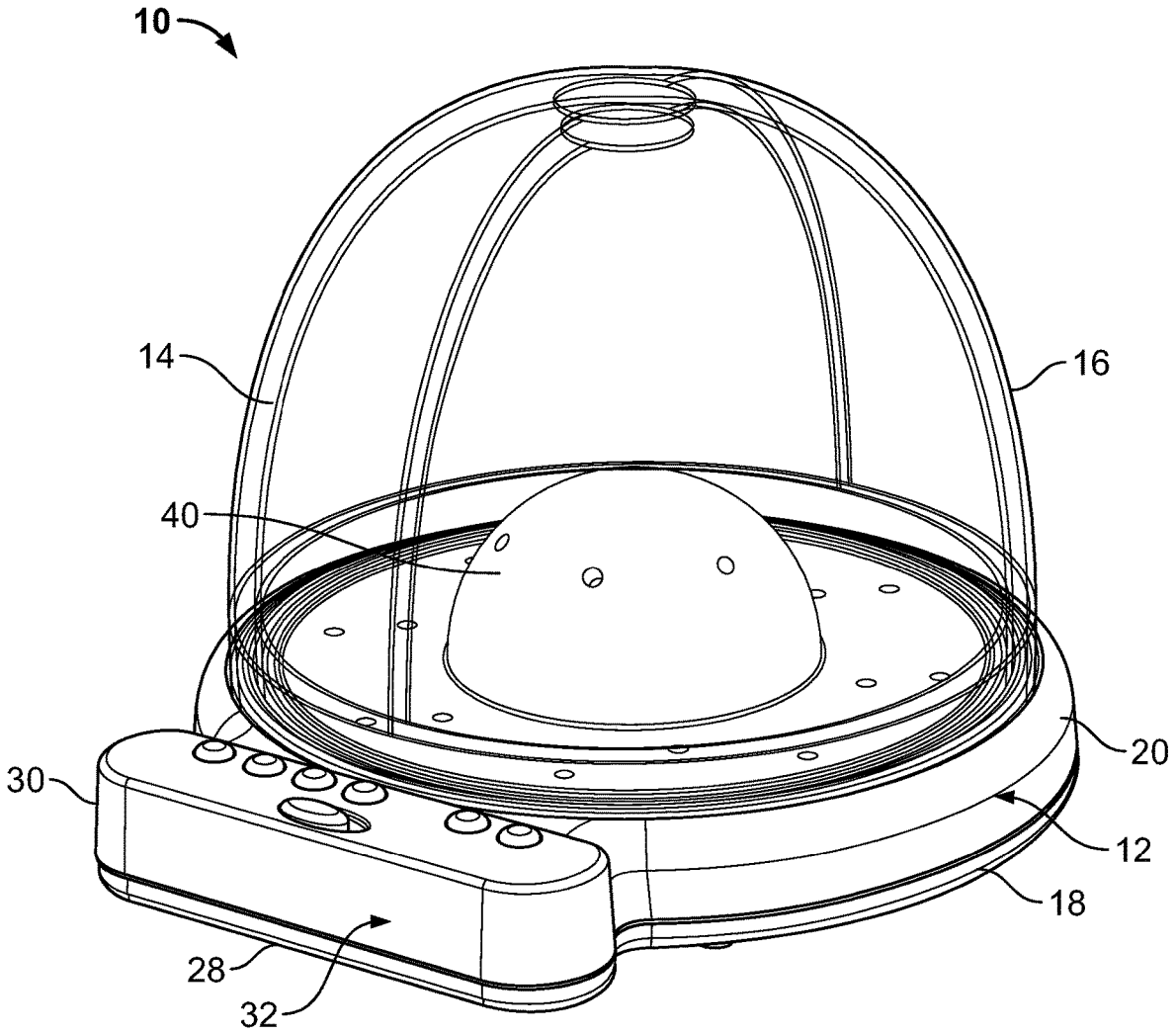
FIG. 1 is a perspective view of a dual-globe amusement device constructed in accordance with an embodiment of the present invention.

Embodiments are now discussed in more detail referring to the drawings that accompany the present application. In the accompanying drawings, like and/or corresponding elements are referred to by like reference numbers.

Various embodiments are disclosed herein; however, it is to be understood that the disclosed embodiments are merely illustrative of the disclosure that can be embodied in various forms. In addition, each of the examples given in connection with the various embodiments is intended to be illustrative, and not restrictive. Further, the figures are not necessarily to scale, and some features may be exaggerated to show details of particular components (and any size, material and similar details shown in the figures are intended to be illustrative and not restrictive). Therefore, specific structural and functional details disclosed herein are not to be interpreted as limiting, but merely as a representative basis for teaching one skilled in the art to variously employ the disclosed embodiments.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein, which embodiments are provided merely to be illustrative. Among other things, for example, subject matter may be embodied as methods, devices, components, or systems. The following detailed description is, therefore, not intended to be taken in a limiting sense.

Throughout the specification and/or claims, terms may have nuanced meanings suggested or implied in context beyond an explicitly stated meaning. Likewise, the phrase "in one embodiment" as used herein does not necessarily refer to the same embodiment and the phrases "in another embodiment" and "other embodiments" as used herein do not necessarily refer to a different embodiment. It is intended, for example, that covered or claimed subject matter include combinations of exemplary embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Figure 2:
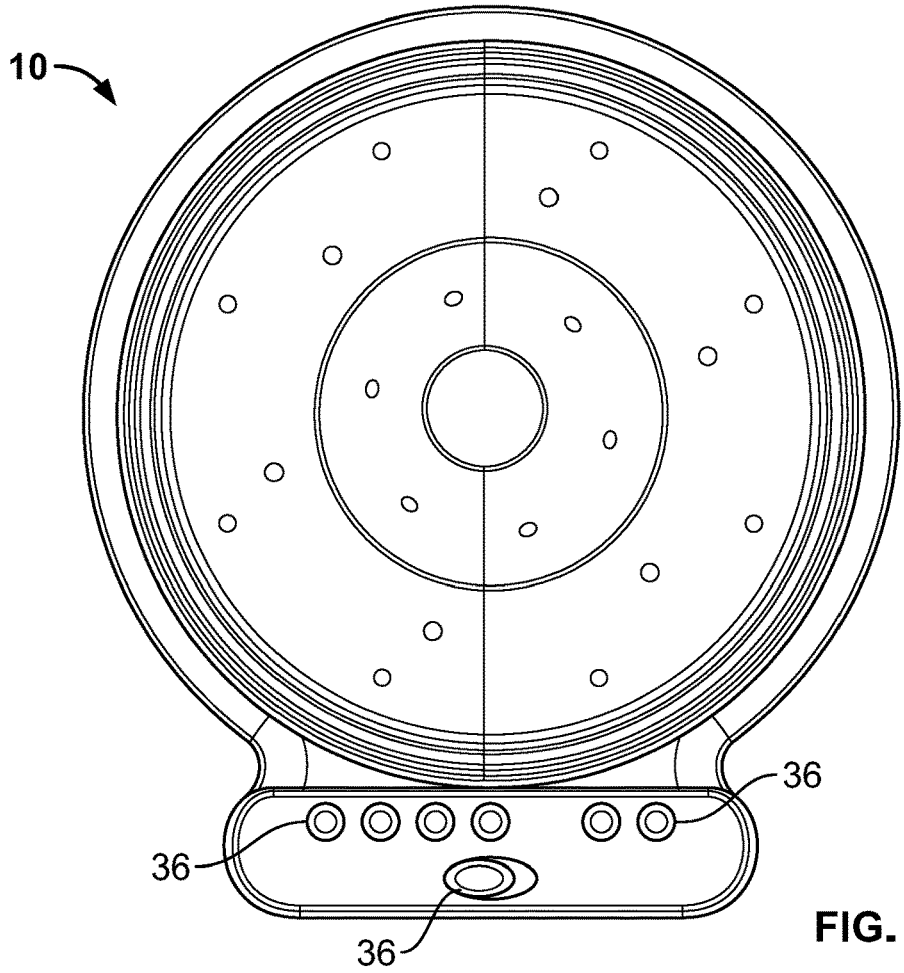
FIG. 2 is a top plan view of the dual-globe amusement device shown in FIG. 1.
Figure 3:
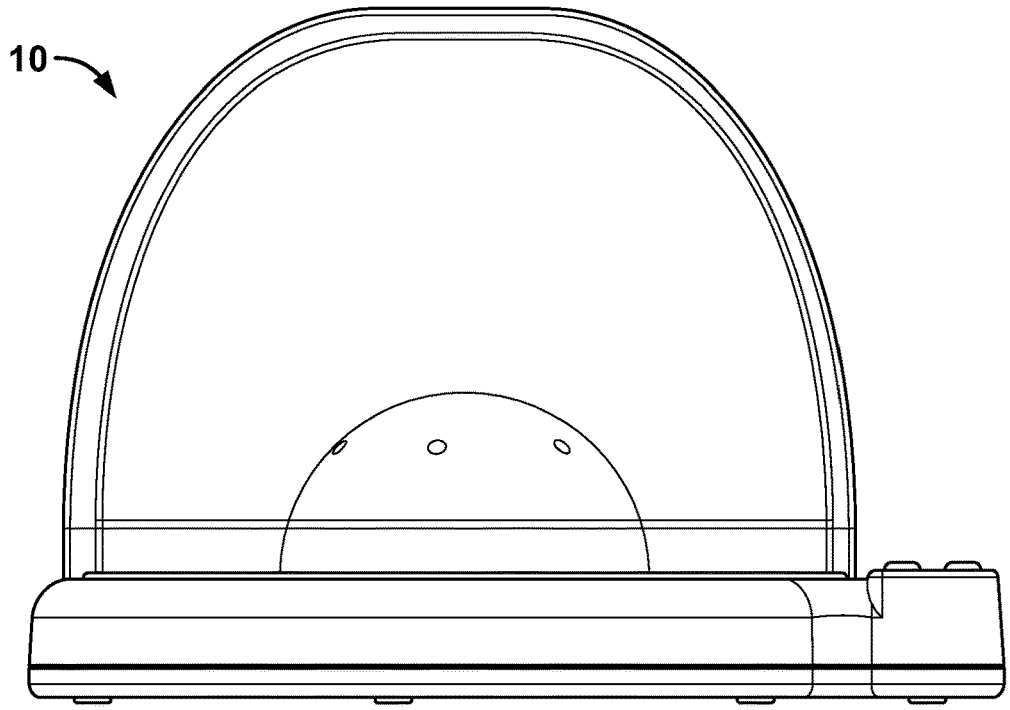
FIG. 3 is a left side elevational view of the dual-globe amusement device shown in FIG. 1.

FIGS. 1-3 show an amusement device 10 constructed in accordance with an embodiment of the present invention. More particularly, the amusement device 10 includes a housing 12 and inner and outer hemispherical-like covers 14, 16 removably mounted on the housing 12. The housing 12 has a bottom housing section (i.e., base) 18 and an upper housing section 20, which is mounted on the bottom housing section 18. An annular support plate 22 (see FIGS. 4 and 5) is fixedly secured to the bottom housing section 18, while a rotatable track or mounting ring 24 (see FIGS. 4 and 5) is rotatably positioned on the support plate 22 and includes a ring-shaped groove 26 (see FIG. 6) for purposes to be discussed hereinbelow.

Figure 4:
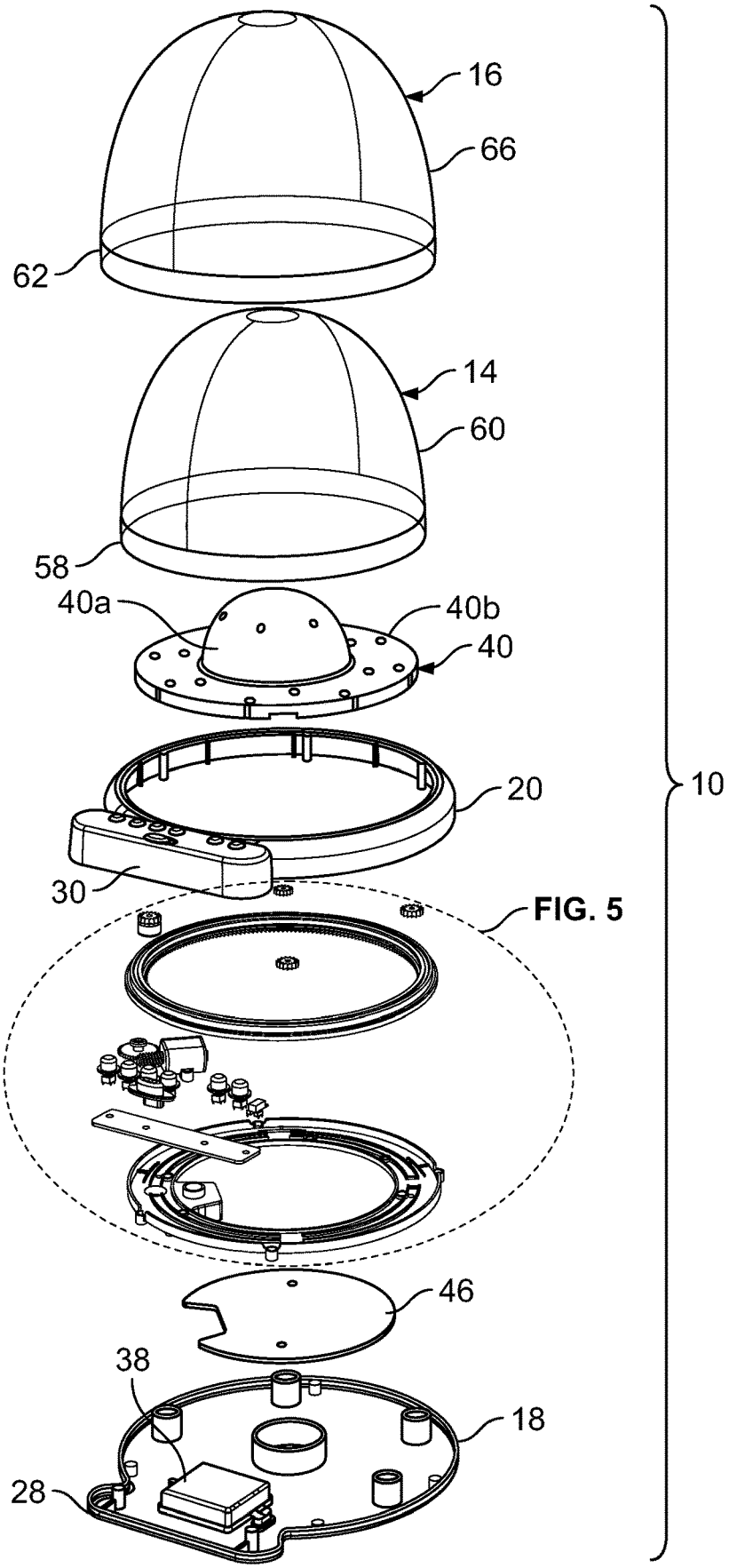
FIG. 4 is an exploded, perspective view of the dual-globe amusement device shown in FIG. 1.

Now referring to FIGS. 1 and 4, the bottom and upper housing sections 18, 20 have laterally projecting portions 28, 30 respectively, which mate with one another to form a compartment 32 therebetween for receiving various electronic components therein. A controller (i.e., control unit) 34 is positioned in the compartment 32 for controlling the operation of the amusement device 10. In one embodiment, the controller 34 is in the form of a printed circuit board ("PCB"). Various control buttons 36 (see FIGS. 2 and 5) are provided for engaging with the controller 34. The bottom housing section 18 also includes a receptacle 38 for receiving and storing a power source, such as a battery.

Figure 5:
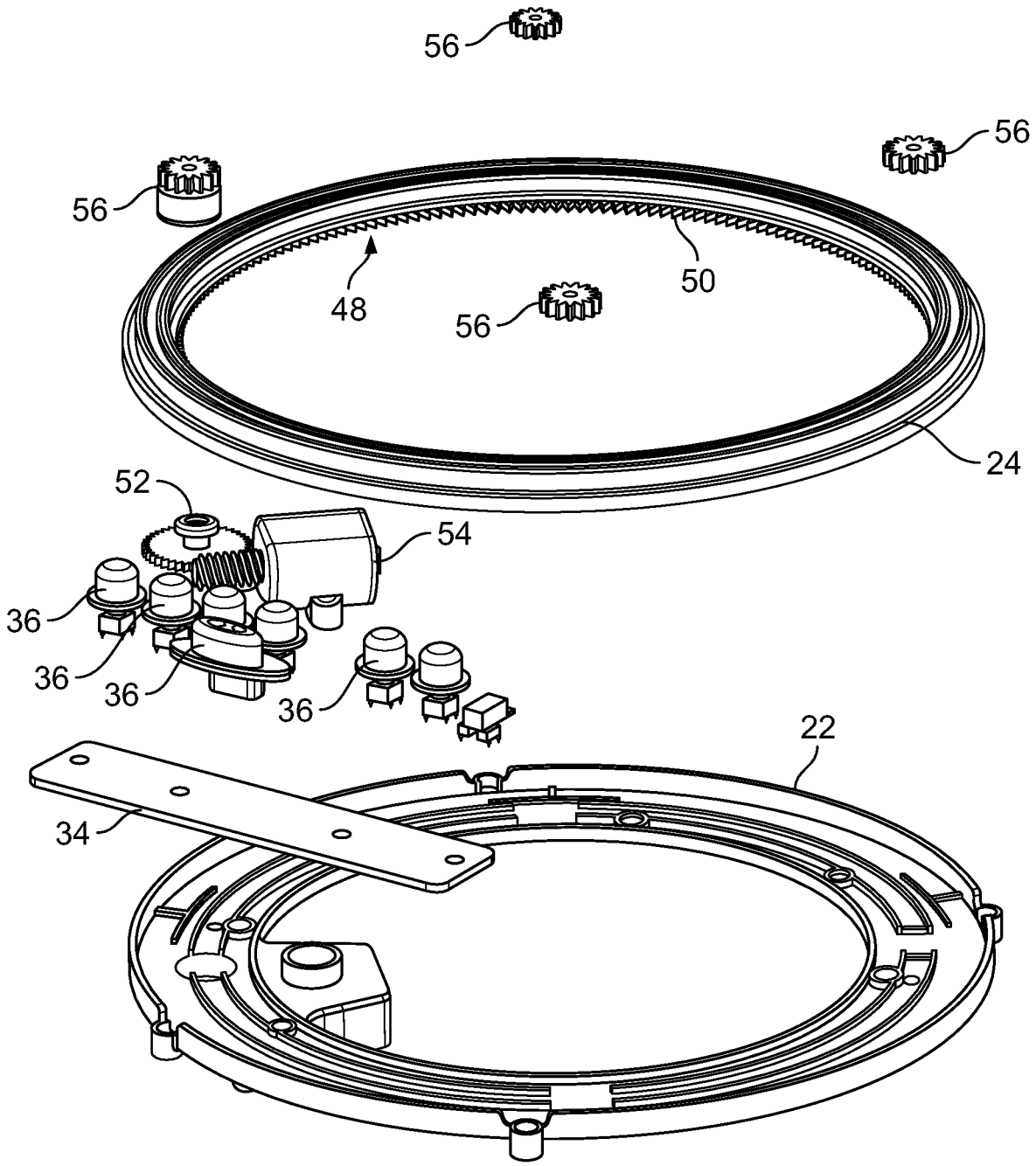
FIG. 5 is an enlarged view of a portion of the dual-globe amusement device shown in FIG. 4.

With reference to FIGS. 1, 4 and 5, a light unit 40 is positioned on the housing 12 for illuminating the amusement device 10. In one embodiment, the light unit 40 includes a hemispherical section 40*a* and a planar section 40*b* projecting from the hemispherical section 40*a*. The light unit 40 is also provided with a plurality of apertures 42 and light elements 44, such as LED light elements, each of which is positioned in a corresponding one of the apertures 42. In one embodiment, a PCB 46 is provided within the housing 12 and connected to the light elements 44 and the controller 34 for the proper operation of the light elements 44.

In one embodiment, the track or mounting ring 24 includes a gear 48 formed on a bottom, inner portion thereof (see FIG. 5). More particularly, the gear 48 includes a plurality of gear teeth 50 provided along the entire circumference of the inner bottom portion of the track 24. A gear system 52 (see FIG. 5) is arranged on the support plate 22 and/or on the bottom housing section 18. The gear system 52, which includes an electrical motor (i.e., motor unit) 54 connected to the controller 34, engages the gear teeth 50 so as to rotate the track 24 when the controller 34 activates the motor 54. In one embodiment, guide gears 56 (see FIG. 5) are positioned on the support plate 22 and/or the bottom housing section 18 for engaging the gear teeth 50 so as to guide the rotational movement of the track 24. It is noted that the inner cover 14 may be rotated by any suitable rotating mechanism, which will be apparent to a person skilled in the art.

Figure 6:
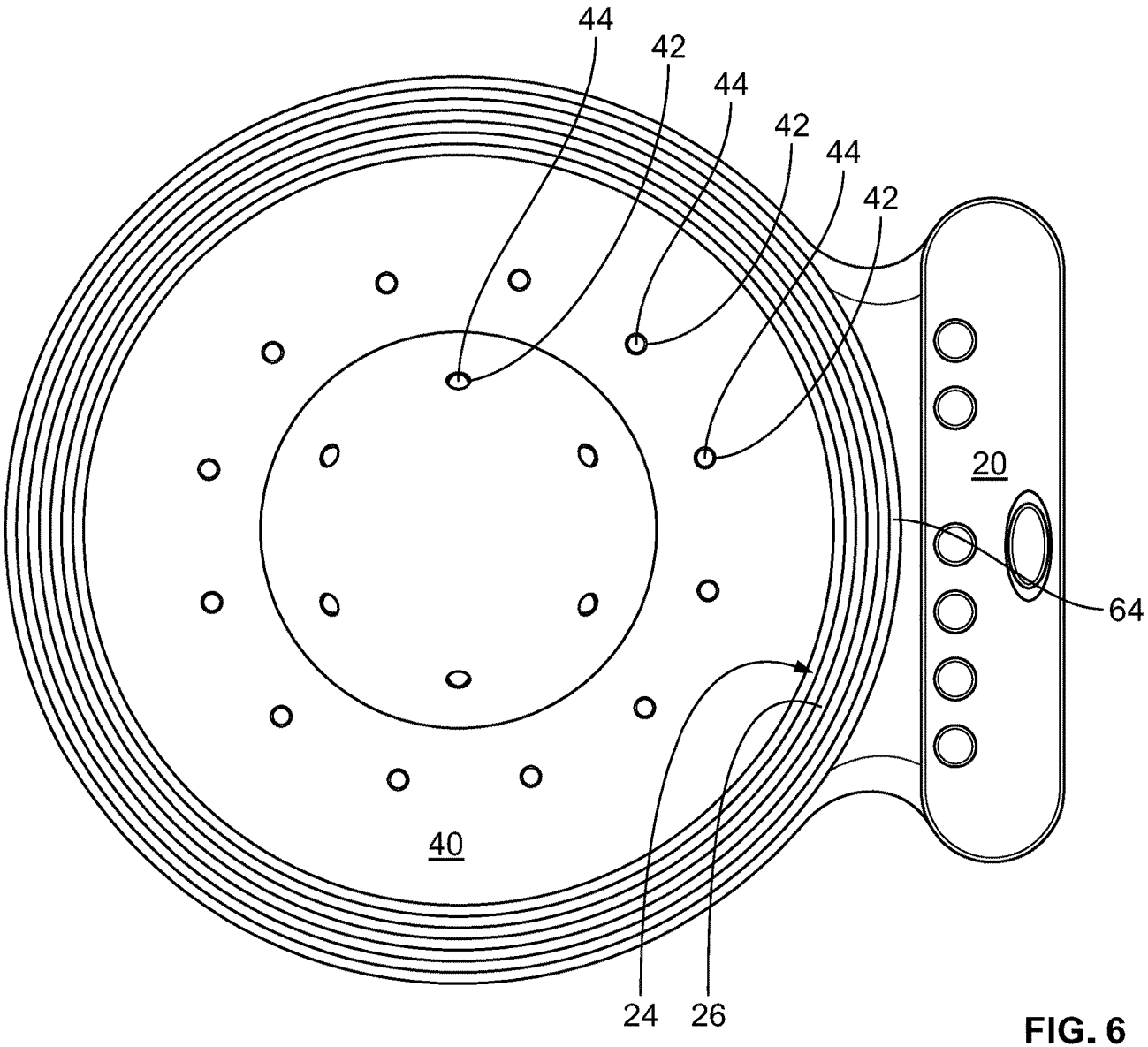
FIG. 6 is a top plan view of the dual-globe amusement device shown in FIG. 1, with its globes or covers removed.

Now referring to FIGS. 1, 4 and 6, the inner cover 14, which is placed on the housing 12 over the light unit 40, includes a lower annular bottom or rim 58 sized and shaped so as to be removably received in the groove 26 of the track 24. More particularly, the rim 58 of the inner cover 14 fits snugly in the groove 26 such that the inner cover 14 rotates together with the track 24 when the motor 54 is energized by the controller 34.

In one embodiment, the inner cover 14 is translucent so as to allow light from the light elements 44 to pass therethrough such that the outer cover 16 can be illuminated. In one embodiment, the inner cover 14 can be made from, or coated with, a translucent material. Because the inner cover 14 is translucent, the light unit 40 is hidden from view, and the inner cover 14 appears to be "glowing" when the light elements 44 are illuminated.

In one embodiment, the inner cover 14 has an outer hemispherical surface 60 (see FIG. 4) on which a user may write or draw using one or more writing or drawing tools, such as erasable markers, crayons, pens, etc. More particularly, a user may write or draw various letters, designs, pictures, etc. on the outer hemispherical surface 60 so as to create a moving image when the motor 54 is energized to rotate the track 24 and the inner cover 14. In another embodiment, materials, such as removable stickers, decorations, etc., may be placed on the outer hemispherical surface 60 of the inner cover 14.

Now referring to FIGS. 1, 4 and 6, the outer cover 16 has an annular bottom or rim 62 which sized and shaped so as to be removably received in a ring-shaped groove 64 (see FIG. 6) formed on the upper housing section 20. As a result, the outer cover 16 does not rotate relative the housing 12 and remains stationary while the inner cover 14 is rotated.

In one embodiment, the outer cover 16 is transparent such that the inner cover 14 and designs written or drawn thereon are visible to a user through the outer cover 16. The outer cover 16 also has an outer hemispherical surface 66 (see FIG. 4) on which a user may write or draw with one or more writing or drawing tools, such as erasable markers, crayons, pens, etc. More particularly, a user may write or draw various letters, designs, pictures, etc. on the outer hemispherical surface 66. In another embodiment, materials, such as removable stickers, decorations, etc., may be placed on the outer hemispherical surface 66 of the outer cover 16. In yet another embodiment, an inner hemispherical surface of the outer cover 16 may be used to write, draw or otherwise place one or more images thereon. As used herein, the term "image" or "marking" means anything that is or can be written, drawn or placed, either temporarily or permanently, on the inner and/or outer covers 14, 16.

The image placed on the outer cover 16 is superimposed on or over the image placed on the inner cover 14. When the motor 54 is activated by pressing one of the control buttons 36, the inner cover 14 rotates together with the image placed thereon. As a result, the image on the inner cover 14 moves relative to the image on the outer cover 16 (which remains stationary) so as to provide a unique visual effect. To further enhance amusement, the device 10 may be equipped with a sound system, including a speaker.

Figure 7:
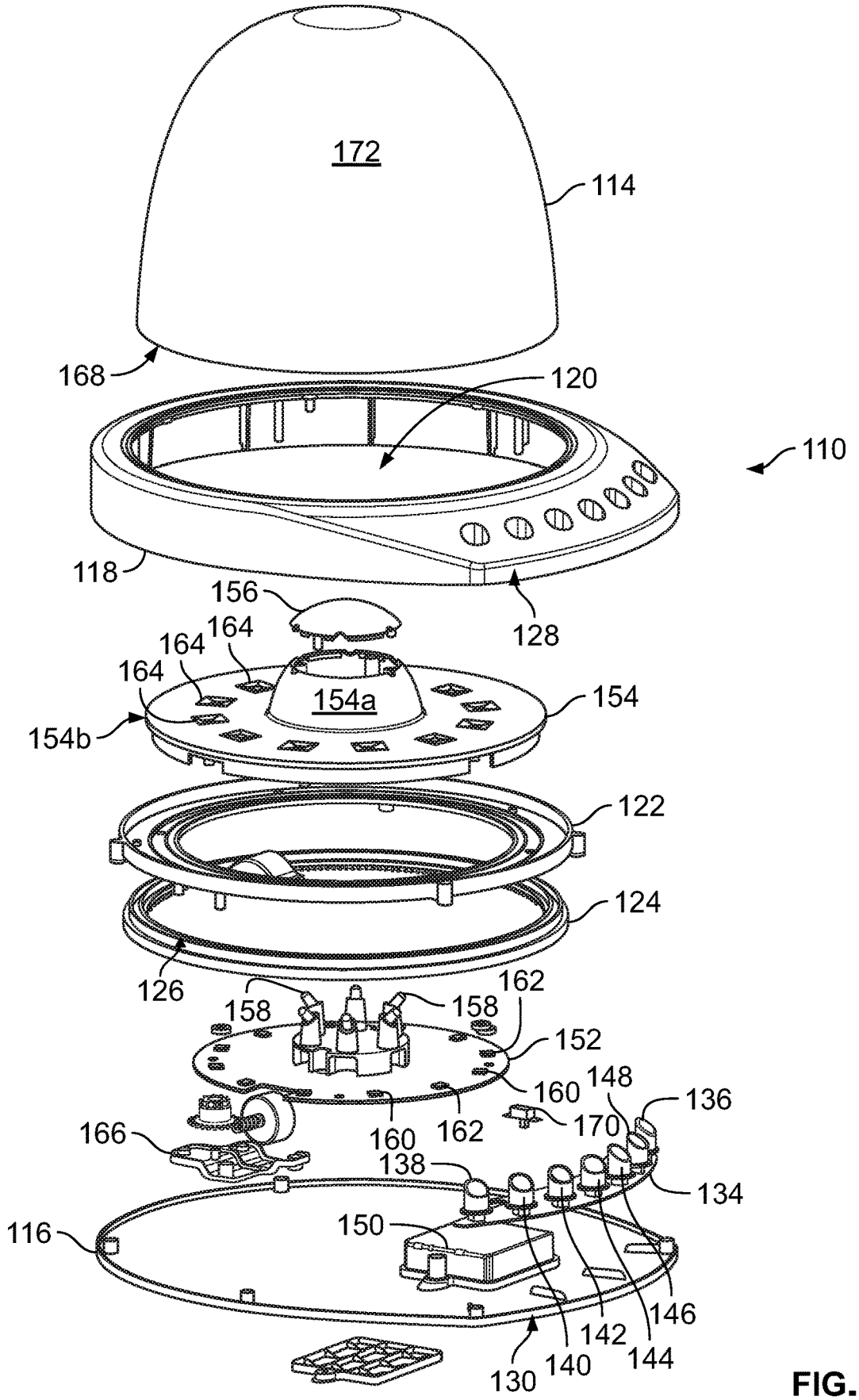
FIG. 7 is an exploded perspective view of a single-globe amusement device constructed in accordance with an embodiment of the present invention.
Figure 8:
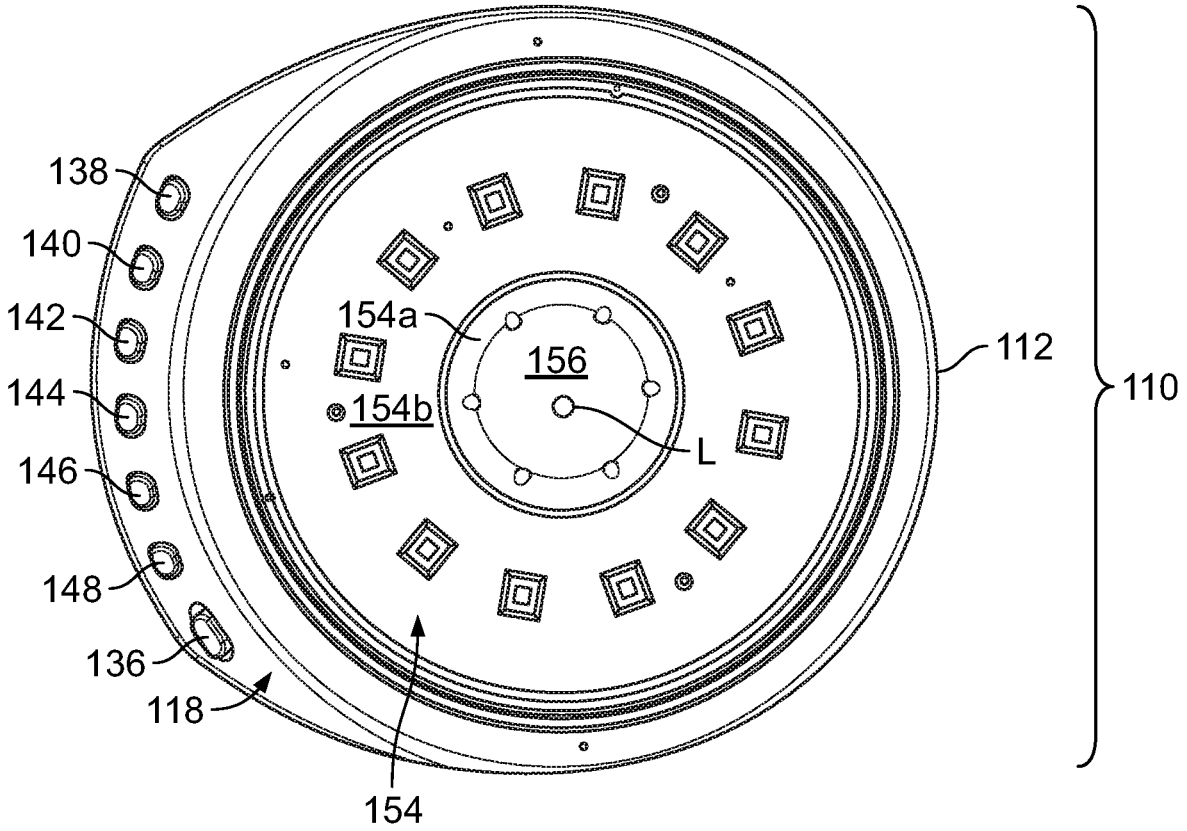
FIG. 8 is a top plan view of the single-globe amusement device shown in FIG. 7, with its globe or cover removed.
Figure 9:
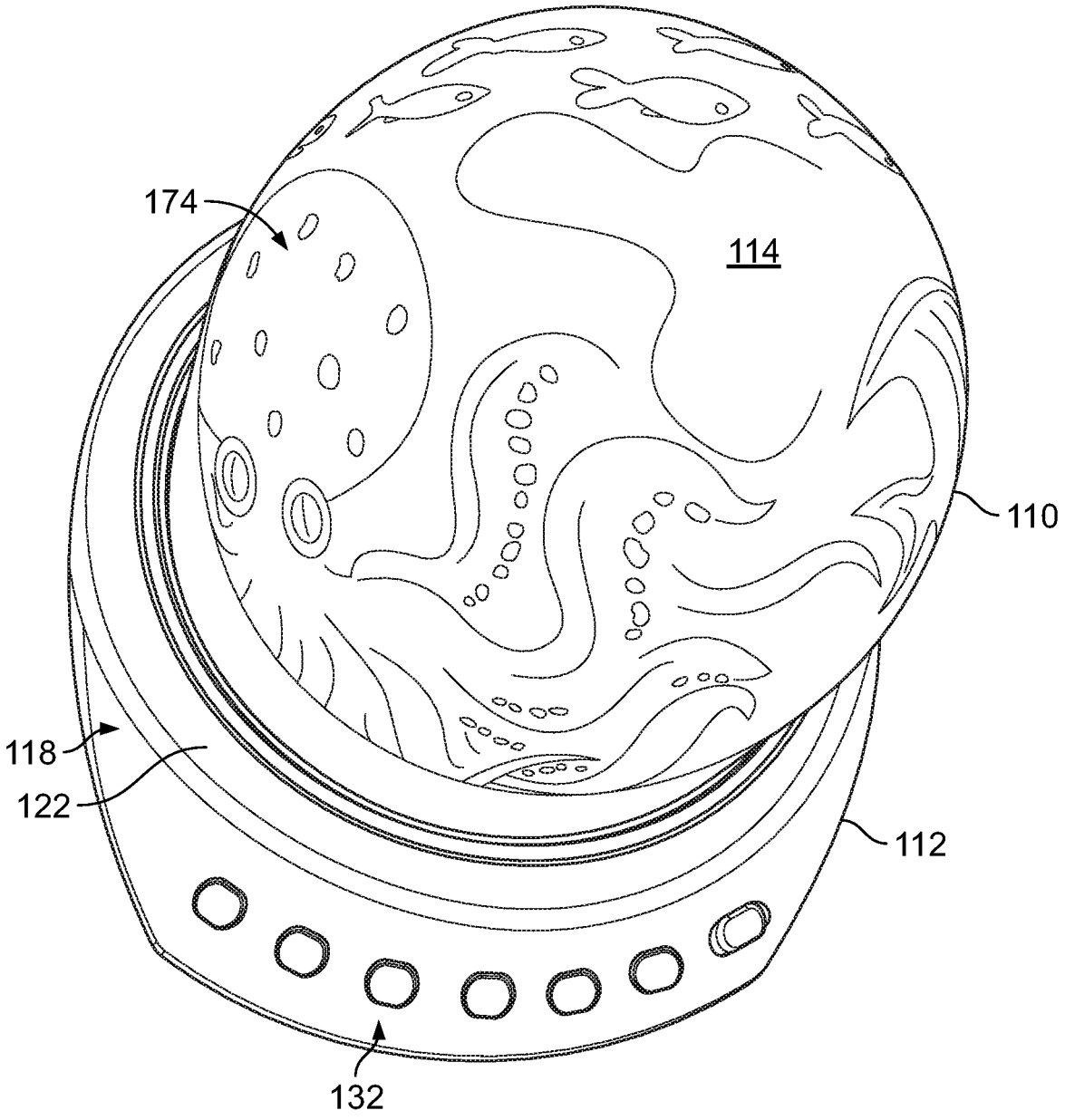

FIGS. 7-9 show an amusement device 110 constructed in accordance with an embodiment of the present invention. More particularly, the amusement device 110 includes a housing 112 and a dome-shaped (i.e., hemispherical-like) cover 114 removably mounted on the housing 112. The housing 112 has a base plate (i.e., base) 116, which is adapted to allow the device 110 to be placed on a support surface (e.g., a tabletop, desk, floor, etc.), and a ring-shaped upper casing 118, which is coupled to base plate 116 to form a cavity 120. An annular support frame 122 (see FIG. 7) is fixed in place and runs along the perimeter of the cavity 120. Support frame 122 surrounds an annular track 124 (i.e., mounting ring) that is rotatably positioned on the base plate 116 and includes a ring-shaped groove 126 for purposes to be discussed hereinbelow.

Still referring to FIG. 7, the base plate 116 and the upper casing 118 have laterally projecting portions 128 and 130, respectively, which mate with one another to form a compartment 132 therebetween for receiving various electronic components therein. A control switch board (i.e., control unit) 134 is positioned in the compartment 132 for controlling the operation of the amusement device 110. In one embodiment, the control switch board 134 is in the form of a printed circuit board ("PCB"). Various control buttons 136, 138, 140, 142, 144, 146, 148 (see FIGS. 7-9) are provided for engaging with the control switch board 134. The base plate 116 also includes a receptacle 150 for receiving and storing a power source (not shown), such as a battery.

With reference to FIG. 7, an LED fixed board 152 is coupled to base plate 116 and placed beneath an LED light board 154, which cooperates with fixed board 152 to function as a light unit. Boards 152 and 154 are framed by annular track 124 and are sized such that cavity 120 is essentially filled. LED light board 154 is positioned on the housing 112 for illuminating the amusement device 110. In one embodiment, the light board 154 includes a hemispherical section 154*a* and a planar section 154*b* projecting from the hemispherical section 154*a*. An optional cap 156 may be coupled to hemispherical section 154*a*. The LED fixed board 152 is provided with a plurality of light elements, such as central light elements 158, peripheral light elements 160 and UV light elements 162. Central light elements 158 may be localized beneath the hemispherical section 154*a*; likewise, peripheral light elements 160 and UV light elements 162 may be localized beneath the planar section 154*b*. As shown in FIG. 7, the peripheral light elements 160 are disposed in an alternating arrangement with the UV light elements 162. The light board 154 may comprise a plurality of apertures 164, whereby light elements 158, 160, 162 can shine therethrough.

From an operational standpoint, the control switch board 134 is coupled to the light elements 158, 160, 162 to allow for their activation and deactivation. The control switch board 134 can also control a motor drive assembly (i.e., motor unit) 166 located within housing 112, which assembly functions to drive the annular track or mounting ring 124 through a gear system (not shown) similar to gear system 52 described hereinabove. In this vein, the annular track 124 may include gear teeth similar to gear teeth 50 described hereinabove.

The motor drive assembly 166 includes an electrical motor (not shown) adapted to rotate the annular track 124 when the control switch board 134 activates the motor drive assembly 166. In one embodiment, guide gears (not shown), similar to guide gears 56 described hereinabove (see FIG. 5) are positioned on the base plate 116 so as to guide the rotational movement of the annular track 124. It is noted that the annular track 124 may be rotated by any suitable rotational mechanism, which will be apparent to persons skilled in the art.

A button or switch, such as control button 136, may be used to control the motor drive assembly 166 according to the intent of a user. In an embodiment, control button 136 can be a sliding button with three fixed positions: a position for clockwise motion, a position for counterclockwise motion and a center position. When the button 136 is in the center position, it is in the "off" position. In operation, the motor drive assembly 166 functions to rotate the dome-shaped cover 114 in two directions (i.e., clockwise and counterclockwise).

The dome-shaped cover 114, which is placed on the housing 112 over the light board 154, includes a lower annular rim 168 sized and shaped so as to be removably received in the groove 126 of the annular track 124. More particularly, the lower annular rim 168 of the cover 114 fits snugly in the groove 126 such that the dome-shaped cover 114 rotates conjointly with the annular track 124 when the motor drive assembly 166 is energized by the control switch board 134. The dome-shaped cover 114 cooperates with the light board 154 to define a substantially hyperboloid space, which space is illuminated when the control switch board 134 is utilized to selectively actuate one or more of the light elements 158, 160 and 162.

The LED fixed board 152 and light board 154 are actuated by the control switch board 134 according to a user's selective pressing of the one or more programmable buttons 138, 140, 142, 144, 146, 148, in addition to button 136, which controls the motor drive assembly 166. Buttons 138, 140, 142, 144, 146, 148 independently and selectively control the light elements 158, 160 and 162.

In an embodiment, a main power button 170 is located under the device 110, next to the battery compartment 132. To enable operation of the device 110, main power button 170 should be in its "on" position.

In the disclosed embodiment, button 138 toggles the peripheral light elements 160 on and off. In other words, button 138 turns "colors" LEDs 160 on. In an embodiment, button 140 cycles the light elements 160, between various colors. Each time button 140 is pressed, a different color will light up. While the disclosed embodiment features eight different light colors, including white, it will be understood that more or fewer colors may be utilized.

Some of the buttons 142, 144 may initiate or remove certain light effects. In the disclosed embodiment, button 142 toggles a "fading" effect which will cause the colors to slowly fade in and out. In other words, the brightness of light elements 160 will slowly decrease to an "off" state before slowly increasing back to the original brightness and restarting the cycle. Button 144 can toggle a blinking effect, wherein light elements 160 quickly alternate between on and off states (i.e., the selected color will blink on and off). The blinking functionality can be combined with or can be independent from the fading effect. In the disclosed embodiment, pressing either of button 142 or the button 144 while the other is engaged will disable an active effect. It should also be noted that routine modifications are contemplated as part of the present invention. For instance, modifying the light effects of buttons 142, 144 to actuate light elements 160 differently.

In the disclosed embodiment, button 146 can toggle the UV light elements 162 between an "on" state and an "off" state. Button 146 will light up the UV LEDs 162, and these lights cause specially adapted marker inks to glow on the dome-shaped cover 114. The functionality of button 146 and its associated UV light elements 162 can be independent of the aforementioned light effects (e.g., fading and blinking) of light elements 158 and/or 160, but it should be understood by persons of skill in the relevant art that buttons 138, 140, 142, 144 146 and 148 could be configured in such a way that allows any UV light effects to be synchronized with, or otherwise placed in temporal relationship, with the LED light effects of light elements 158, 160. Similarly, the UV light elements 162 may exhibit the same effect as the light elements 158, 160, or a different light effect, depending on the configuration. In other embodiments, the button 146 can also toggle light effects associated with UV lights 162. In other embodiments, the relative illumination may be varied, such as by actuating more or fewer light elements 158, 160, 162.

In the disclosed embodiment, button 148 can turn the central light elements 158 on and off. Also in the disclosed embodiment, button 148 can cycle the central light elements 158 between multiple modes, each one being activated when button 148 is pressed. For instance, the modes could include but are not limited to, "off", "constant light", "slow blink", "blinking light", "circling light" (i.e., blinking between lit and unlit states while varying the light color), and/or changing the light color of light elements 158. The light effects produced by the central light elements 158 can be independent of the light effects produced by light elements 160, 162, if applicable, or can be placed in a temporal relationship therewith. Finally, it is noted that any and all of the light effects mentioned hereinabove can also be implemented in embodiments that have dual globes, such as the embodiment of FIGS. 1-6.

In an embodiment, the dome-shaped cover 114 is translucent so as to allow light from the light elements 158, 160, 162 to pass therethrough such that the cover 114 can be illuminated. In one embodiment, the cover 114 can be made from, or coated with, a translucent material. Because the cover 114 is translucent, the light board 154 is hidden from view, and the cover 114 appears to be "glowing" when the light elements 158, 160, 162 are illuminated.

In one embodiment, the cover 114 has an outer hemispherical surface 172 (see FIG. 9) on which a user may write or draw using one or more writing or drawing tools (not shown), such as erasable markers, crayons, pens, etc. When marketed as a kit, such writing or drawing tools may be included with the amusement device 110 along with other accessories (e.g., instructions, batteries, stencils, stickers, etc.). More particularly, a user may write or draw various markings 174 (e.g., letters, designs, pictures, etc.) on the outer hemispherical surface 172 so as to create a moving image when the motor drive assembly 166 is energized to rotate the annular track 124 and consequently the cover 114. To achieve this moving image, button 136 may be used.

In various embodiments, materials, such as removable stickers, decorations, etc., may be placed on the outer hemispherical surface 172 of the cover 114 to further enhance amusement. To a similar end, the device 110 may be equipped with a sound system, including a speaker (not shown).

It will be understood that the embodiments described herein are merely exemplary and that a person skilled in the art may make many variations and modifications without departing from the spirit and scope of the invention. All such variations and modifications are intended to be included within the scope of the invention, as defined by the appended claims.

The invention claimed is:

1. An amusement device, comprising a housing with a base for mounting said housing on a support surface; a light unit positioned on said housing and including a hemispherical section and a planar section extending laterally outwardly from said hemispherical section such that said planar section encircles said hemispherical section; a first plurality of light elements positioned on said hemispherical section in a circular pattern and oriented at a first angle, at least some of said first plurality of light elements being LED light elements; a second plurality of light elements mounted on said planar section in a circular pattern and oriented at a second angle, which is different from said first angle, at least some of said second plurality of light elements being UV light elements; a mounting ring rotatably positioned on said housing and encircling said light unit; a translucent, dome-shaped cover mounted for rotation on and conjointly with said mounting ring, said translucent, dome-shaped cover arching over said light unit and having sufficient opacity such that said light unit is hidden from a user's view when said translucent, dome-shaped cover is placed over said light unit, said translucent, dome-shaped cover having an outer hemispherical surface adapted to receive user-placed markings thereon and an inner hemispherical surface cooperating with said light unit to define a substantially hyperboloid space positioned between said translucent, dome-shaped cover and said light unit, whereby said light unit is adapted to illuminate said translucent, dome-shaped cover and any markings on said outer hemispherical surface thereof; a motor unit positioned in said housing for rotating said mounting ring; and a control unit positioned in said housing and having first means for actuating said motor unit such that said translucent, dome-shaped cover is rotatable conjointly with said mounting ring in response to the actuation of said motor unit, whereby markings on said outer hemispherical surface of said translucent, dome-shaped cover are rotatable relative to said first and second plurality of light elements, said control unit further including second means for selectively and independently actuating said LED light elements and said UV light elements, thereby providing for variable illumination of said translucent, dome-shaped cover and any markings on said outer hemispherical surface thereof.

2. The amusement device of claim 1, wherein said UV light elements are configured to interact with markings on said outer hemispherical surface of said translucent, dome-shaped cover to produce a glowing effect.

3. The amusement device of claim 1, wherein said outer hemispherical surface of said translucent, dome-shaped cover is adapted to receive markings in the form of letters, designs, pictures, stickers and/or other decorations.

4. The amusement device of claim 1, wherein at least some of said second plurality of light elements are LED light elements.

5. The amusement device of claim 4, wherein said control unit is configured to actuate said light unit and cause said first plurality of light elements and/or said second plurality of light elements to produce one or more light effects.

6. The amusement device of claim 5, wherein said one or more light effects comprises a fading effect.

7. The amusement device of claim 5, wherein said one or more light effects comprises a blinking effect.

8. The amusement device of claim 5, wherein said one or more light effects comprises a circling light effect.

9. The amusement device of claim 5, wherein said one or more light effects comprises a changing light color effect.

10. The amusement device of claim 5, wherein multiple light effects of said one or more light effects are placed in a temporal relationship with respect to each other.

11. The amusement device of claim 10, wherein said multiple light effects are synchronized.

12. The amusement device of claim 1, wherein said control unit is configured to actuate said light unit and cause said first plurality of light elements and/or said second plurality of light elements to produce one or more light colors.

13. The amusement device of claim 1, wherein said control unit is configured to be actuated by a plurality of buttons accessible to a user.

14. The amusement device of claim 1, further comprising a sound system including a speaker.

15. The amusement device of claim 1, wherein said motor unit in configured to provide both clockwise and counter-clockwise motion to said mounting ring.

16. An amusement device, comprising a housing with a base for mounting said housing on a support surface; a light unit positioned on said housing and including a hemispherical section and a planar section extending laterally outwardly from said hemispherical section such that said planar section encircles said hemispherical section, said hemispherical section including a first plurality of light elements mounted thereon in a circular pattern and oriented at a first angle, and said planar section including a second plurality of light elements mounted thereon in a circular pattern and oriented at a second angle, which is different from said first angle; a mounting ring rotatably positioned on said housing and encircling said light unit; an inner cover made from a translucent material such that said light unit is hidden from view when said inner cover is placed over said light unit, said inner cover being sized and shaped so as to be mounted on said mounting ring for conjoint rotation therewith, said inner cover having an outer hemispherical surface adapted for placement of a first set of markings thereon; a transparent outer cover sized and shaped so as to be mounted in a stationary location on said housing above and spaced from said inner cover, said outer cover having an outer hemispherical surface adapted for covering said inner cover and for placement of a second set of markings thereon, said light unit being adapted to illuminate said inner cover and any of said first set of markings placed thereon and to illuminate said outer cover and any of said second set of markings placed thereon; a motor unit positioned in said housing for conjointly rotating said mounting ring and said inner cover; and a control unit positioned in said housing and adapted to actuate said motor unit such that said inner cover is rotatable relative to said outer cover in response to the actuation of said motor unit, whereby any of said first set of markings placed on said inner cover are rotatable relative to any of said second set of markings placed on said outer cover.

* * * * *